United States Patent [19]

Lee

[11] 4,363,154

[45] Dec. 14, 1982

[54] MACHINE FOR REMOVING INK FROM OVERHEAD PROJECTOR ROLLS

[76] Inventor: Robert K. Lee, 1312 Parsnip Crescent, Prince George, British Columbia, Canada, V2M 4C41

[21] Appl. No.: 263,695

[22] Filed: May 14, 1981

[30] Foreign Application Priority Data

Jun. 16, 1980 [CA] Canada ..... 354058

[51] Int. Cl.[3] ..... B08B 11/20

[52] U.S. Cl. ..... 15/102; 15/100; 134/64 P

[58] Field of Search ..... 15/77, 100, 102; 134/64 R, 64 P, 122, 9, 15

[56] References Cited

U.S. PATENT DOCUMENTS

| | | | |
|---|---|---|---|
| 1,669,394 | 5/1928 | Ellis et al. | 15/100 |
| 1,933,084 | 10/1933 | Allison | 15/100 |
| 3,737,941 | 6/1973 | Miller et al. | 15/100 |

*Primary Examiner*—Edward L. Roberts

[57] ABSTRACT

A machine, to be used in schools, for removing ink from overhead projector rolls of writing-film. The machine comprises a holder for the roll of writing-film, a take-up spool onto which the writing-film can be transferred, nozzles for applying solvent of the ink to the writing-film as it is being transferred to the take-up spool, and rubber blades for wiping the writing-film.

22 Claims, 11 Drawing Figures

MACHINE FOR REMOVING INK FROM OVERHEAD PROJECTOR ROLLS

CROSS-REFERENCES TO RELATED APPLICATIONS

Applicant has not filed any other U.S. application claiming this invention.

FIELD OF THE INVENTION

This invention relates to means for removing ink from overhead projector rolls of writing-film.

DESCRIPTION OF THE PRIOR ART

Teachers find that an overhead projector equipped with a roll of writing-film is an effective teaching aid. An overhead projector roll of writing-film consists of a strip of transparent film, about twenty-five centimeters wide and fifteen meters long, which is wound on an overhead projector spool, a spool which can be mounted on, and used with, an overhead projector. The writing-film is used by cranking it from the spool, across the stage of an overhead projector, onto another overhead projector spool. The teacher writes on the film as he gives his lecture, and the writing is projected onto a screen. Gradually, the entire roll becomes covered with writing—although an overhead projector roll of writing-film consists of about fifteen meters (fifty feet) of film, a high school teacher with four clases a day can use a roll-up in less than a week. Once a roll of used up, it must be cleaned, or replaced with a new roll. If a used roll of writing-film is cleaned carefully, it is as good as a brand-new one, and there is a considerable saving of money since new rolls cost approximately twenty dollars. When, as is common, water-soluble ink has been used to write on the writing-film, the roll can be cleaned by wiping it by hand with water-dampened paper towels. This is usually done by slowly winding the writing-film across the stage of the overhead projector, stopping frequently to wipe the ink from the surface of the film. It takes fifteen or twenty minutes of work to clean the entire roll. Teachers dislike the job, not only because it is time consuming (fifteen minutes is often not available between classes, and after school the time is better spent on lesson preparation), but because it usually results in one getting ink on the overhead projector and on one's clothing and hands (even water-soluble ink is difficult to remove from the skin). Another problem with wiping the film by hand is that the paper towels must be turned frequently and then discarded. If they are not, they will just smear the ink. Often one goes through quite a pile of paper towels to clean a full length roll. As well, when hand cleaning lower quality writing-film, care must be taken not to tear the film. This is because one's wiping strokes are generally crossways or oblique to the length of the film, thus stressing the film along its weak edges. Tears are particularly prone to occur if the edge of the film is accidently caught. Because of these problems, teachers often replace a used roll of writing-film with a brand-new one. Schools spend hundreds of dollars a year on new rolls while used rolls, which could have been cleaned and used again, accumulate on classroom shelves.

SUMMARY OF THE INVENTION

My invention, a machine for removing ink from overhead projector rolls of writing-film, overcomes the disadvantages of wiping writing-film by hand. My machine comprises means for holding an overhead projector roll of writing-film and the overhead projector spool that the roll of writing film is on, the roll being free to turn and to unroll when held; a take-up spool, and means for turning it, for rerolling the roll; means for applying solvent of the ink to the writing-film as it is being transferred unrolled to the take-up spool by the turning of the take-up spool; and means for removing the solvent from the writing-film.

Preferably, the solvent applying means is enclosed in a lidded basin located between the holding means and the take-up spool, and consists of means for spraying the solvent onto the writing-film as it passes across the basin, beneath the lid. A rough bottom surface on the lid prevents the writing-film from adhering to the lid.

Advantageously, the spraying means includes one or more nozzles directed towards the lid and couplable to a pressurized solvent source external to the machine. Solvent flow to the nozzles can be controlled by a valve on the machine. A shield around the nozzles helps to control where the solvent spray goes.

If the ink is water-soluble, as is often the case, water can be used as the solvent and obtained by a connection to a faucet.

Preferably, the means for removing the solvent from the writing-film is one or more resilient wiper blades mounted in the basin so as to press against the writing-film as it travels to the take-up spool for rerolling.

A drain in the bottom of the basin allows used solvent, that has fallen or been wiped from the writing-film, to be withdrawn from the basin.

Preferably, the machine has means for turning the overhead projector spool so as to wind the writing-film from the take-up spool back onto the overhead projector spool, the spool that the writing-film was on before being cleaned. Absorbent matter can be situated so as to wipe the writing-film as it is being returned to its original spool, thus removing residual amounts of solvent.

Using my machine, an overhead projector roll of writing-film can be washed and dried in under three minutes. Compared to wiping by hand, the film suffers less damage and the teacher gets much less ink on his hands. With my invention, more writing-film rolls will be used over and over, resulting in a considerable saving of money to schools.

BRIEF DESCRIPTION OF DRAWINGS

In drawings which illustrate the preferred embodiment of my invention.

DESCRIPTION OF THE PREFERRED EMBODIMENT

Figure 1:
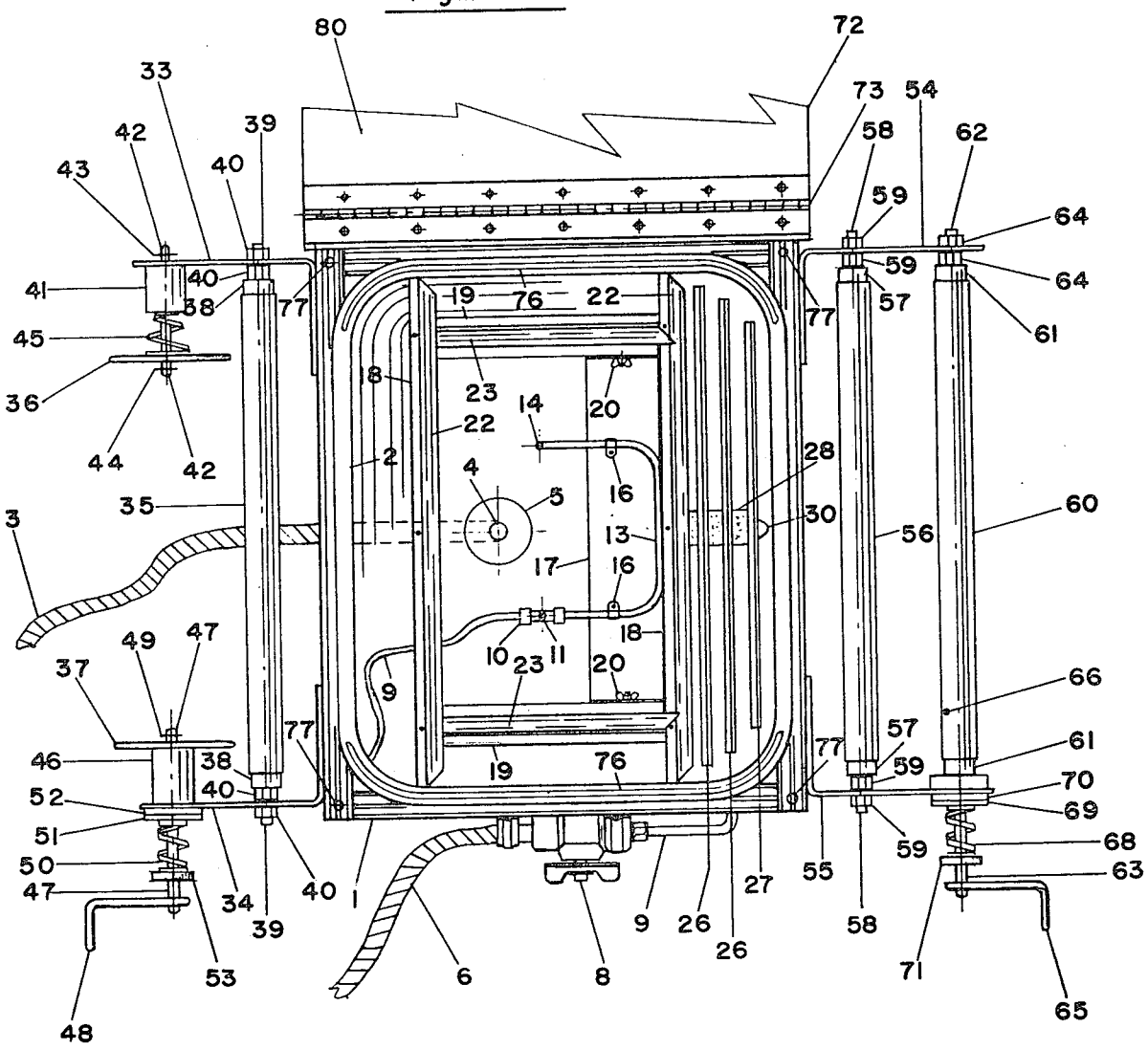
FIG. 1 is a top view of the embodiment with its lid open; drawn one-quarter actual size, the lid not fully shown in the diagram.
Figure 2:
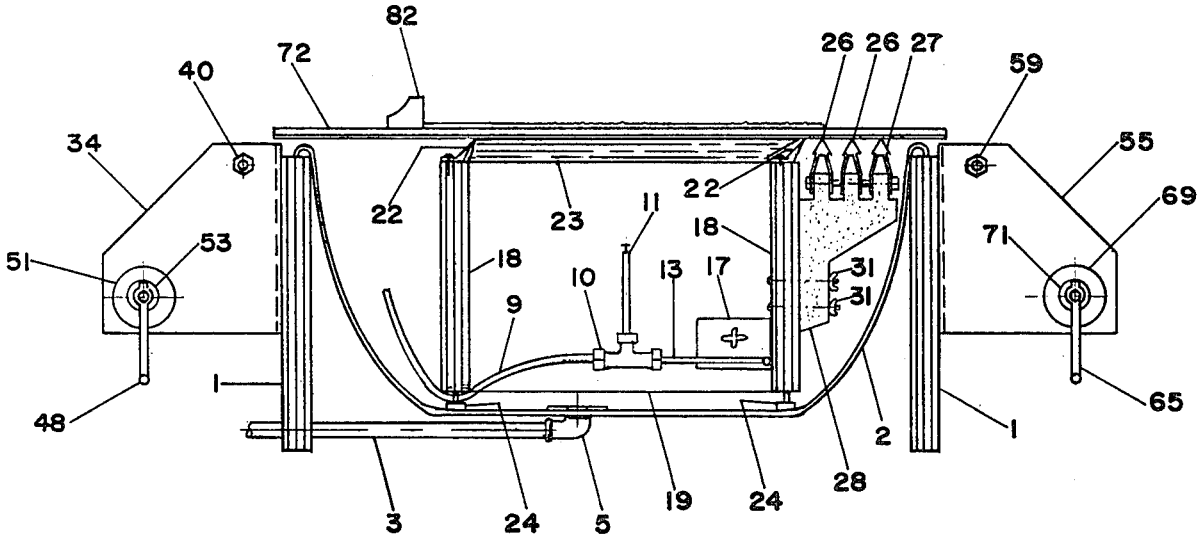
FIG. 2 is a front view of the embodiment, showing its appearance if the near side of the basin holder and the basin were cut away; drawn approximately one-fifth actual size.

The preferred embodiment of my invention includes a varnished wooden frame 1 consisting of four pieces of plywood joined together with wood screws, which serves as a holder for a rectangular plastic basin 2. The plastic basin 2 measures thirty-two by twenty-eight centimeters and is thirteen centimeters deep. The basin 2 has a rounded lip which supports it in the basin holder 1.

Alternatively, the basin 2 and its holder 1 could be molded from a plastic or fiberglass as a single unit.

A two centimeter inside diameter flexible hose 3, one and one-half meters in length, passes through a hole in the lower part of the basin holder 1, and is connected to a drain hole 4 in the bottom of the basin 2 by means of an elbow fitting 5. The hose 3 serves as a drainhose for ink-laden water when a roll of writing-film is being washed. Another piece of flexible hose 6, which has an inside diameter of one and one-quarter centimeters and is two meters long, has one of its ends equipped with a standard, threaded garden-hose coupling 7, or alternatively, a dishwasher-style hose-head, so that it can be attached to a faucet. The other end of the hose 6 is attached to a valve 8, which is mounted with screws to the outside of the basin holder 1. The valve 8 controls the flow of water from the facet, through the hose 6, into the machine. The valve 8 is of a type that is easily opened and closed by hand.

Plastic tubing 9, having an inside diameter of one-half centimeter, is attached to the excurrent end of the valve 8. The plastic tubing 9 leads through a small hole in the basin holder 1, and through another small hole in the top part of the basin 2. Inside the basin 2, the plastic tubing 9 is attached by means of a "T"-fitting 10 to a water nozzle 11 consisting of a six centimeter length of one-half centimeter inside diameter stainless steel tubing 11 pinched in one place so a tapered-head wood screw 12 remains lodged in its bore; and to a longer piece of one-half centimeter inside diameter stainless steel tubing 13 which terminates as a second water nozzle 14 about ten centimeters away from the first nozzle 11. The second water nozzle 14 also consists of a tapered-head wood screw 15 lodges in the bore of a stainless steel tube 14. When the hose 6 is attached to a faucet supplying cold water, and the faucet and the valve 8 are opened, each of the nozzles 11,14 produce a cone-shaped spray of water, which, together, are approximately the same width as the writing-film. The cone-like shape of the sprays is due to the tapered-head screws 12,15, which deflect the water as it emanates from the tubes 11,14. Other styles of nozzles producing other spray shapes can be substituted, provided they do not permit excessive through-flow and wastage of water.

Figure 3:
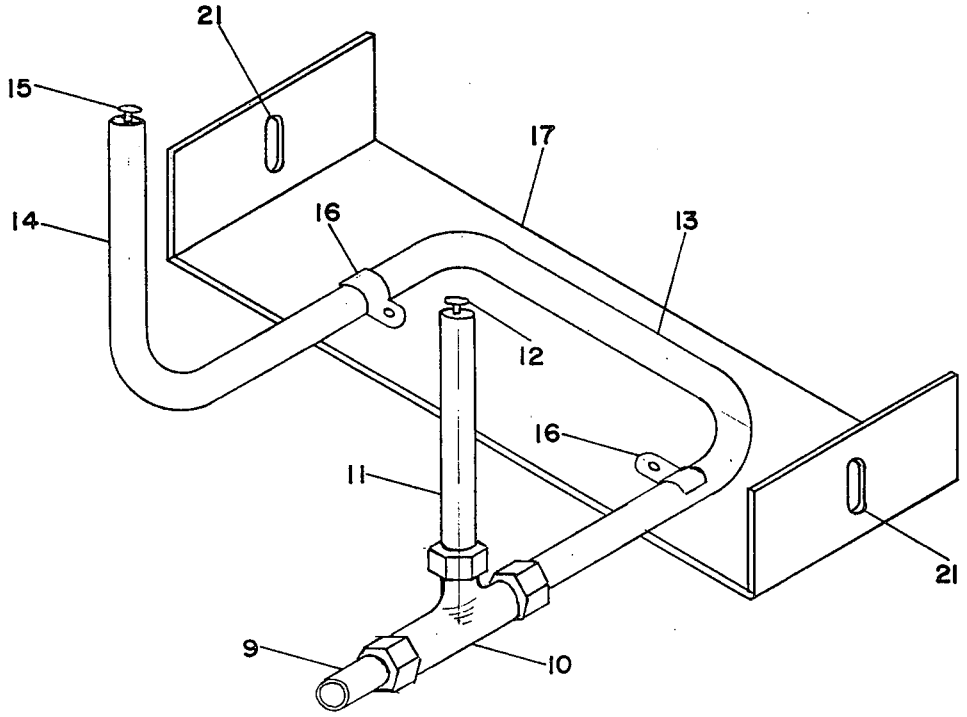
FIG. 3 is a view of the embodiment's nozzles and aluminum platform, drawn approximately full size.
Figure 4:
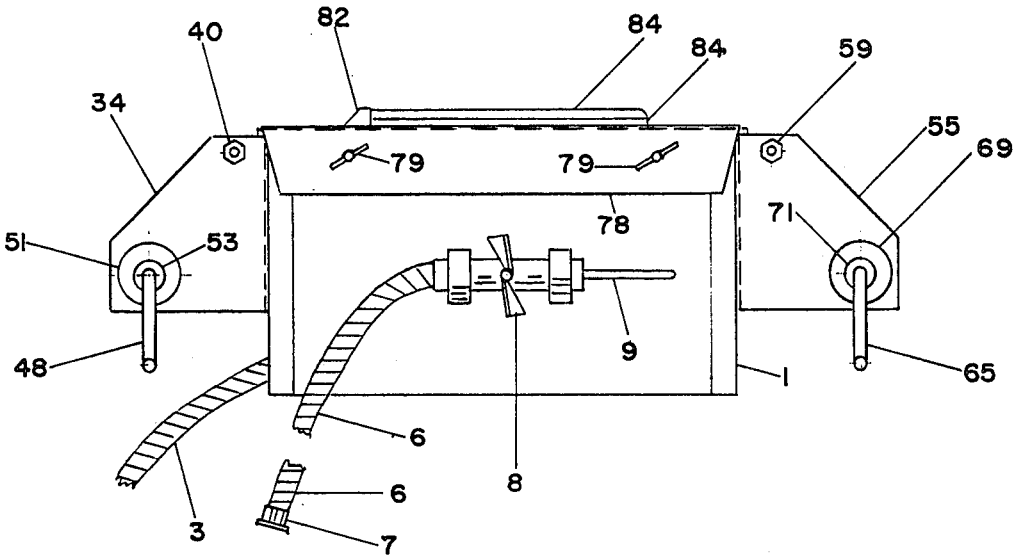
FIG. 4 is a front view of the embodiment, drawn approximately one-fifth actual size.
Figure 5:
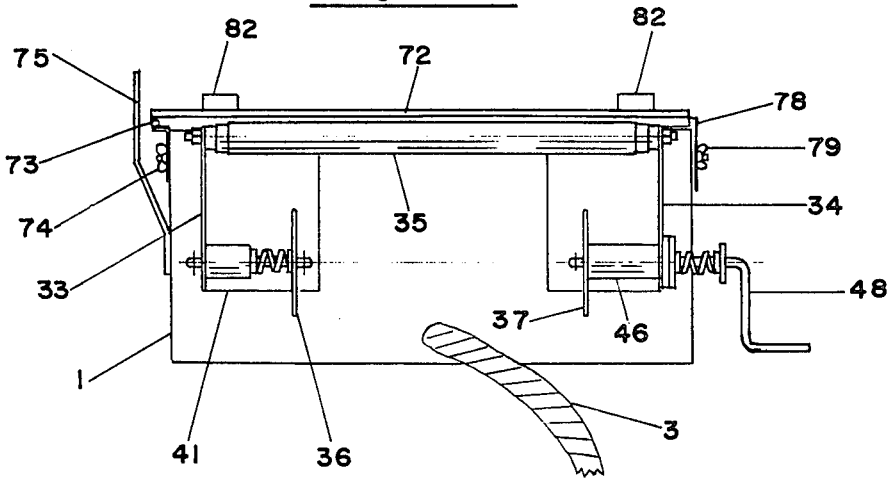
FIG. 5 is a view of the film inlet side of the embodiment, showing an idle roller and the spool holder; drawn approximately one-fifth actual size.
Figure 6:
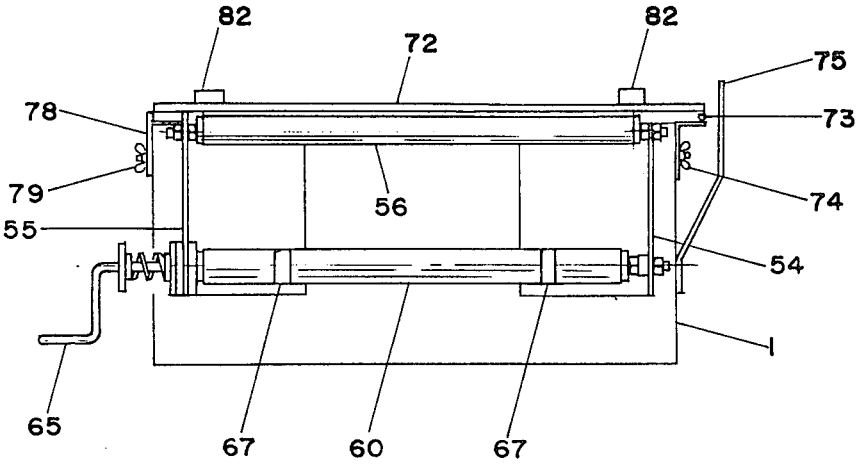
FIG. 6 is a view of the film outlet side of the embodiment, showing an idle roller and the take-up spool; drawn approximately one-fifth actual size.
Figure 8:
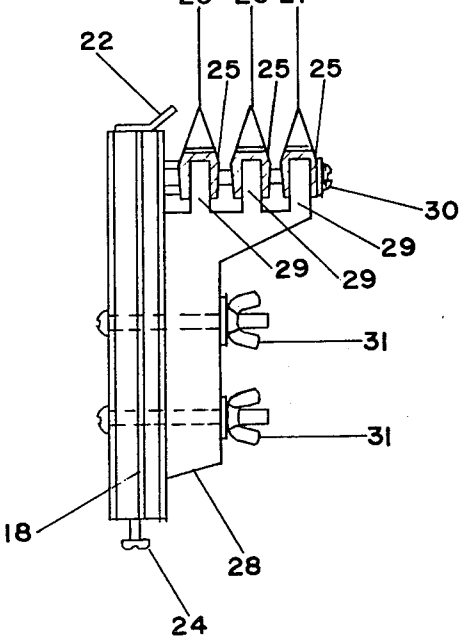
FIG. 8 is a side view of the embodiment's three wiper blades and wiper blade holders mounted on the tongued block; drawn one-half actual size.
Figure 7:
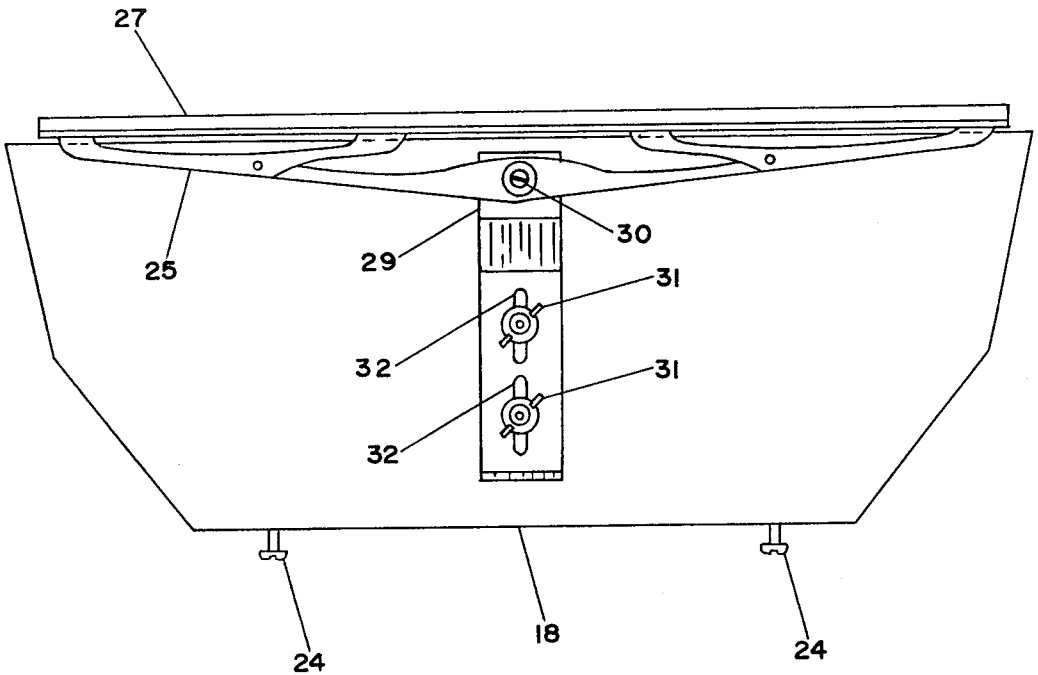
FIG. 7 is a front view of one of the wiper blades and wiper blade holders used in the embodiment, showing the wiper blade holder mounted on a tongued block which is fastened to a wooden assembly; drawn one-half actual size.
Figure 9:
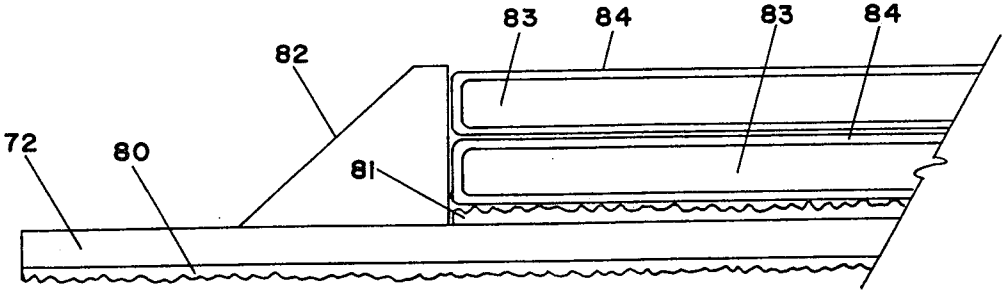
FIG. 9 is an end view of a portion of the embodiment's lid, showing the three layers of plastic used in the lid, the figure also showing an end view of a portion of the two cloth covered plates which can be used atop the lid; drawn full size.

The nozzles 11,14 are attached with small brackets 16 to an aluminum platform 17 which is bent so it has a vertical flange at each end, as shown in FIG. 3. The aluminum platform 17 is located in the center region of a varnished wooden assembly. This wooden assembly comprises four pieces of plywood 18,19 which sit on edge inside the basin 2, and which are joined together with wood screws. Two of the wooden pieces 18 are thirty-two centimeters long and extend across the basin 2, whereas the other two wooden pieces 19 are fifteen centimeters long and serve as connecting pieces between the two longer pieces 18. The flanges of the aluminum platform 17 are attached by means of two machine screws and wing nuts 20 to the lower part of the two connecting pieces 19 in the wooden assembly 18,19. By this arrangement, the nozzles 11,14 are held near the bottom of the basin 2, the excurrent ends of the nozzles 11,14 directed upwards; and the wooden assembly 18,19 forms a shield around the nozzles 11,14. Slotted holes 21 in the flanges of the aluminum platform 17 allow the nozzles 11,14 to be moved up or down if the wing nuts 20 are loosened. The alignment of the two nozzles 11,14 is transverse to the length of the writing-film as it travels through the machine and passes over the nozzles 11,14.

Four strips of doorsweep-style weather stripping 22,23 are attached with with screws on the top edges of the wooden assembly 18,19. The weather strips 22,23 are mounted with their rubber blades uppermost. Two of the weather strips 22 have stiff rubber blades and extend across the basin 2, being mounted on the two longer plywood pieces 18 in the wooden assembly 18,19. The blades in these two weather strips 22 slant in the same direction, the direction that the writing-film travels when it is being washed. (The direction of film travel, during washing, is from left to right in FIGS. 1, 2, 4, and 10.) The other two weather strips 23 have pliable rubber blades, and are shorter, being mounted on the two shorter connecting pieces 19 in the wooden assembly 18,19. The pliable rubber blades 23 are slanted inwards, towards the middle of the wooden assembly 18,19. The rubber blades in the four weather strips 22,23 extend about half a centimeter higher than the lip of the basin 2 and press against the writing-film as it is being washed, preventing water spray from getting onto the upper, clean, dry surface of the film or from escaping from the confines of the basin 2. Adjustment of the height of the weather strips 22,23 can be made by means of four wood screws 24 in the bottom edges of the wooden assembly 18,19. Turning the screws 24 with a screwdriver causes the wooden assembly 18,19, including the weather strips 22,23, to be raised or lowered in the basin 2. The screws 24 also maintain a space between the wooden assembly 18,19 and the bottom of the basin 2.

Three windshield wiper blade holers 25, two of them each holding a thirty centimeter long windshield wiper blade 26, and one holding a twenty-seven centimeter long windshield wiper blade 27, are mounted side by side, and with wiper blades 26,27 uppermost, on a plastic block 28 having three tongues 29 that fit into slots in the wiper blade holders 25. A long machine screw 30 inserted through the wiper blade holders 25 and the tongues 29 prevents the wiper blade holders 25 from coming off the tongues 29, but permits the wiper blade holders 25 to tilt somewhat on the tongues 29 in order to help the wiper blades 26,27 make good contact with the writing-film. The wiper blades 26,27 and their holders 25 are located in the basin 2, the tongued block 28 being attached by means of two machine screws and wing nuts 31 to the outside of the wooden assembly 18,19. Thus, the wiper blades 26,27 are held transverse to the direction of film travel, and downstream (in terms of film travel during washing) from the nozzles 11,14. The wiper blades 26,27 press against the wet writing-film, wiping the writing-film as it passes by. By loosening the wing nuts 31 and sliding the tongued block 28 up or down on slotted holes 32, the wiper blades 26,27 can be raised or lowered. To dry the writing-film well, the top edges of the wiper blades 26,27 should be about two millimeters higher than the top edges of the blades in the weather strips 22,23. The wooden assembly 18,19 partitions the wiper blades 26,27 from the nozzles 11,14 preventing writing-film from being sprayed with water after it has been wiped dry by the wiper blades 26,27.

Other materials such as plastic or metal could be used in place of wood in the assembly 18,19.

On the film inlet side of the machine (the left side in FIGS. 1, 2, 4, and 10), a pair of metal brackets 33,34 are fastened with screws to the basin holder 1. The brackets 33,34 support an idle roller 35, which is mounted transverse to the film's course of travel; and also support a holder 36,37 for the writing-film roll's overhead projector spool.

The idle roller 35 is situated over the spool holder 36,37, and is also closer to the basin 2. The top of the idle roller 35 is five centimeters away from the top of the lid of the basin 2, and is just slightly higher than the lip. The idle roller 35 consists of a thirty-two centimeter length of two and one-half centimeter outside diameter aluminum pipe 35 which has both ends fitted with nylon plugs 38. A hole is present in the center of each nylon plug 38, and the idle roller 35 can turn on short axles 39 which extend into the holes. The axles 39 are secured to the brackets 33,34 with nuts 40 which are threaded onto the axles' 39 outer ends.

The spool holder 36,37 consists of two separate sections, one on each of the brackets 33,34. One section includes a short cylindrical piece of nylon 41 having a hole which runs through it longitudinally. One end of the nylon piece 41 is attached to the bracket 33 by means of flat-head machine screws. An axle 42 is inserted through the hole in the nylon piece 41 and through an aligning hole in the bracket 33, and is kept from coming out by a spring pin 43 through its end. The other end of the axle 42 is inserted through a hole in the center of an eight centimeter diameter metal disc 36, and is prevented from coming out by a spring pin 44 and solder. The spring pin 44, together with the axles's 42 tip, form a shape which fits key-like into the ends of all overhead projector spools of common manufacture. A tapered coil spring 45 is located on the axle 42, occupying space left between the metal disc 36 and the nylon piece 41. The metal disc 36 is retractable, and the spring 45 serves to resist retraction of the metal disc 36.

The other bracket 34 also has a cylindrical nylon piece 46 attached to it with flat-head machine screws. The nylon piece 46 serves as support for an axle 47 which is inserted through a hole in the nylon piece 46 and through an aligning hole in the bracket 34. One end of the axle 47 is attached to a crank 48, while the other end of the axle 47 protrudes through a hole in the center of an eight centimeter diameter metal disc 37 and is held there with a spring pin 49 and solder. The metal disc 37 is not retractable, being against the nylon piece 46. The spring pin 49 and the tip of the axle 47 form a shape which is insertable into the ends of overhead projector spools. Thus, two rotatable metal discs 36,37 face one another from a distance of twenty-five centimeters and together can serve to hold an overhead projector spool, and the roll of writing-film which is on the spool, between themselves. When held by the holder 36,37, the roll of writing-film and the overhead projector spool are free to rotate about the overhead projector spool's longitudinal axis, and the roll of writing-film can be unrolled. The spring 45 maintains pressure on the overhead projector spool so it cannot fall from between the metal discs 36,37.

A spring 50 is located on the axle 47, between the crank 48 and the bracket 34, and the force it exerts upon a brake disc 51 faced with rubber 52 is determined by the setting of a small metal disc 53 which is threaded on the axle 47. The brake disc 51,52 is located on the axle 47. When subjected to pressure from the spring 50, the brake disc 51,52 rubs against the bracket 34 and impedes the rotation of the axle 47 and the overhead projector spool, putting an even tension on the writing-film as it is being unrolled and washed.

Directly across the machine, on the film outlet side, are a second pair of metal brackets 54,55. They are fastened to the basin holder 1 with screws. The brackets 54,55 support an idle roller 56 which, like the idle roller 35 on the film inlet side, is approximately level with the lip of the basin 2, and comprises, like the first, a thirty-two centimeter length of two and one-half centimeter outside diameter aluminum pipe 56 fitted with nylon plugs 57 at both ends, and two short axles 58 secured with nuts 59 to the brackets 54,55. The brackets 54,55 also support a take-up spool 60 on which the writing-film can be rerolled. The take-up spool 60 is parallel to the idle rollers 35,56, but is lower, and is also farther away from the basin holder 1. The take-up spool 60 consists of a thirty-two centimeter length of two and one-half centimeter outside diameter aluminum pipe 60 that has both ends fitted with nylon plugs 61. Short axles 62,63 extend into holes in the nylon plugs 61. One axle 62 is secured to the bracket 54 with nuts 64. The other axle 63 passes through a hole in the bracket 55 and is connected to a crank 65. A spring pin 66 which passes through the aluminum pipe 60, the nylon plug 61, and the axle 63 enables one to turn the take-up spool 60 by turning the crank 65. Strips of rubber tape 67 unwrapped around the aluminum pipe 60 help one to get the writing-film started around the take-up spool 60. The idle rollers 35,56 guide the writing-film over the basin 2 as the writing-film is being transferred from the overhead projector spool to the take-up spool 60.

A spring 68 is located on the axle 63, between the crank 65 and the bracket 55, and the force it exerts upon a brake disc 69 faced with rubber 70 is determined by the setting of a small metal disc 71 which is threaded on the axle 63. The brake disc 69,70 is located on the axle 63. When subjected to pressure from the spring 68, the brake disc 69,70 rubs against the bracket 55 and impedes the rotation of the axle 63 and the take-up spool 60, putting an even tension on the writing-film as it is being wound from the take-up spool 60 back onto the overhead projector spool.

An acrylic plastic lid 72 covers the basin 2. The lid 72 is attached to the basin holder 1 with a stainless steel piano-hinge 73. The piano-hinge 73 is mounted on the back side of the basin holder 1 so as not to obstruct the passage of writing-film beneath the lid 72. The piano-hinge 73 is attached to the basin holder 1 by means of two machine screws and wing nuts 74, and the lid's 72 height is adjustable if the wing nuts 74 are loosened and the hinge 73 is slid up or down. When the lid 72 is open, a metal prop 75 fastened to the basin holder 1 prevents the lid 72 from falling over backwards. When the lid 72 is closed, it rests upon foam rubber strips 76 which are one-half centimeter thick and are glued along the top of the lip of the basin 2 where the lip is parallel to, but not transverse to, the path of the writing-film as it travels unrolled beneath the lid 72 to the take-up spool 60. The foam rubber strips 76 maintain a space between the basin 2 and the closed lid 72, permitting the writing-film to pass unrolled between the lid 72 and the basin 2 as it is being transferred from the overhead projector spool to the take-up spool 60. Wood screws 77 in each corner of the basin holder 1 prevent the foam strips 76 from being overly compressed by the lid 72.

When a roll of writing-film is being washed, the lid 72 is fastened down with a latch 78. The latch 78 consists of a long piece of thin metal with one edge bent at ninety degrees. The latch 78 is held to the front of the basin holder 1 by two machine screws and wing nuts 79. To latch the lid 72, the bent edge of the latch 78 is hooked onto the front of the lid 72 and the wing nuts 79 are tightened. For convenience, the latch 78, the valve 8, and the cranks 48,65 are all located on the front of the machine.

A thin sheet of roughly textured plastic 80 is glued to the inside surface of the lid 72. Another sheet of roughly textured plastic 81 is glued to the middle of the outside surface of the lid 72. The rough texture of the plastic sheets 80,81 prevents damp writing-film from adhering to the smooth acrylic plastic 72 and causing excessive drag.

Two plastic blocks 82 about three centimeters high are glued to the outside surface of the lid 72 so they are thirty centimeters apart and aligned with the edge of the lid 72 on the film inlet side of the machine. The blocks 82 are located four centimeters away from this edge and serve as guides for two urethaned pieces of light plywood 83. The plywood plates 83 are inside snugly fitting bags 84 made of moisture absorbent terry cloth. The two terry cloth covered plywood plates 83,84 sit on top of the lid 72,81 and sandwich the writing-film as it is being wound back onto the overhead projector spool. They are used only when it is desired that the writing-film be extra dry.

MODE OF OPERATION OF PREFERRED EMBODIMENT

The preferred embodiment of my invention is used as follows to clean an overhead projector roll of writing-film. When a roll needs cleaning, it (including the overhead projector spool it is on) is disengaged from the overhead projector and mounted in the spool holder 36,37 on my machine. The roll is mounted in the spool holder 36,37 by pushing back the spring-loaded metal disc 36, and fitting the ends of the overhead projector spool onto the protrusions 42,44,47,49 present in the centers of the two metal discs 36,37. The roll is placed in the spool holder 36,37 in such a way that when the writing-film is unrolled, the "dirty" or inky side is facing downward. The lid 72,80,81 of the machine is opened and the end of the writing-film is pulled over the idle roller 35, the basin 2, and the second idle roller 56, and started around the take-up spool 60. The lid 72,80,81 is then closed and the latch 78 is fastened. The hose 6 is connected to a cold water faucet. The valve 8 is opened and water sprays from the two nozzles 11,14 up onto the lower surface of the section of writing-film that is inside the machine. The force of the water spray removes the water-soluble ink from this portion of the roll of writing-film. When the operator of the machine turns the crank 65 attached to the take-up spool 60, the writing-film is advanced and the remainder of the roll is sprayed clean. By tightening the small metal disc 53 against the spring 50, the brake disc 51,52 can be made to slightly impede the rotation of the overhead projector spool, thus putting an even tension on the writing-film as it travels to the take-up spool 60. As the writing-film is being sprayed, the rubber bladed weather strips 22,23, which are mounted on the wooden assembly 18,19, press the writing-film against the inside surface of the lid 72,80, producing slidable, sealing contact between the weather strips 22,23 and the film, thus preventing water spray from getting onto the upper, clean, dry surface of the film or from escaping from the basin 2. Most of the ink-laden water falls from the writing-film to the bottom of the basin 2, and drains through the drainhose 3 to a sink drain. Water that remains clinging to the writing-film is wiped off by the wiper blades 26,27, which the writing-film passes over on its way to the take-up spool 60. The wiper blades 26,27 press the writing-film against the inside surface of the lid 72,80, and wipe very nearly all of the water from the film as the film travels by.

Figure 10:
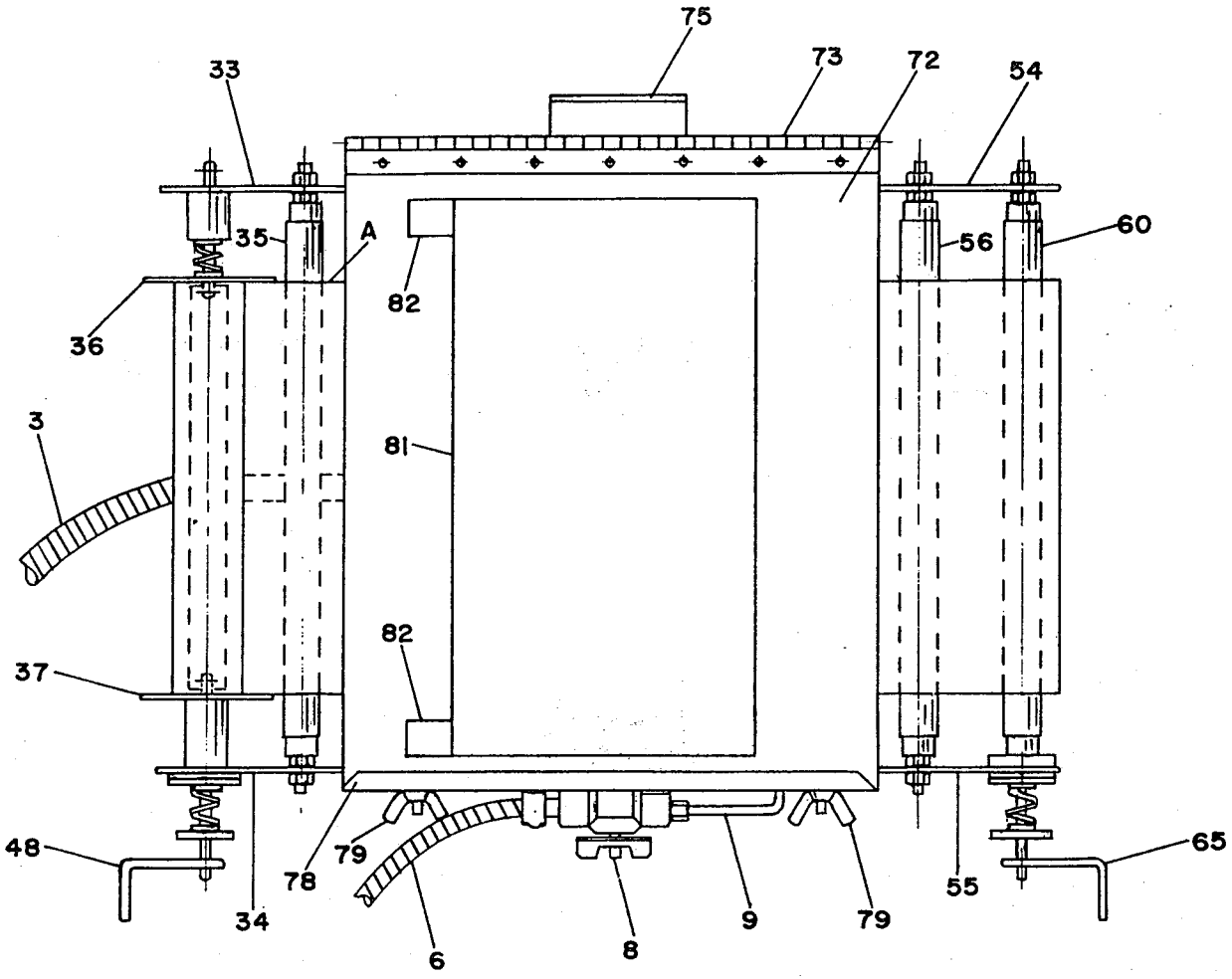
FIG. 10 is a top view of the embodiment, showing writing-film A being washed, the direction of film travel being from left to right; drawn one-quarter actual size.

Writing-film A is shown passing beneath the lid 72,80,81, for washing, in FIG. 10.

After the entire roll of writing-film has been washed, dried, and rerolled on the take-up spool 60, the writing-film is wound back onto its original spool. This is done by pulling the end of the writing-film over the lid 72,80,81, which is still latched closed. The writing-film is started around the overhead projector spool. By turning the crank 48 connected to one side of the spool holder 36,37, all the writing-film is transferred back onto the overhead projector spool. The large metal discs 36,37 guide the writing-film and ensure that a neat roll is reformed on the overhead projector spool. Tightening the small metal disc 71 against the spring 68 causes the brake disc 69,70 to slightly impede the rotation of the take-up spool 60, thus putting an even tension on the writing-film as it travels back to the overhead projector spool. If it is desired that the writing-film be extra dry on both sides, the film can be sandwiched between the two terry cloth covered plates 83,84 as it travels over the lid 72,80,81.

Figure 11:
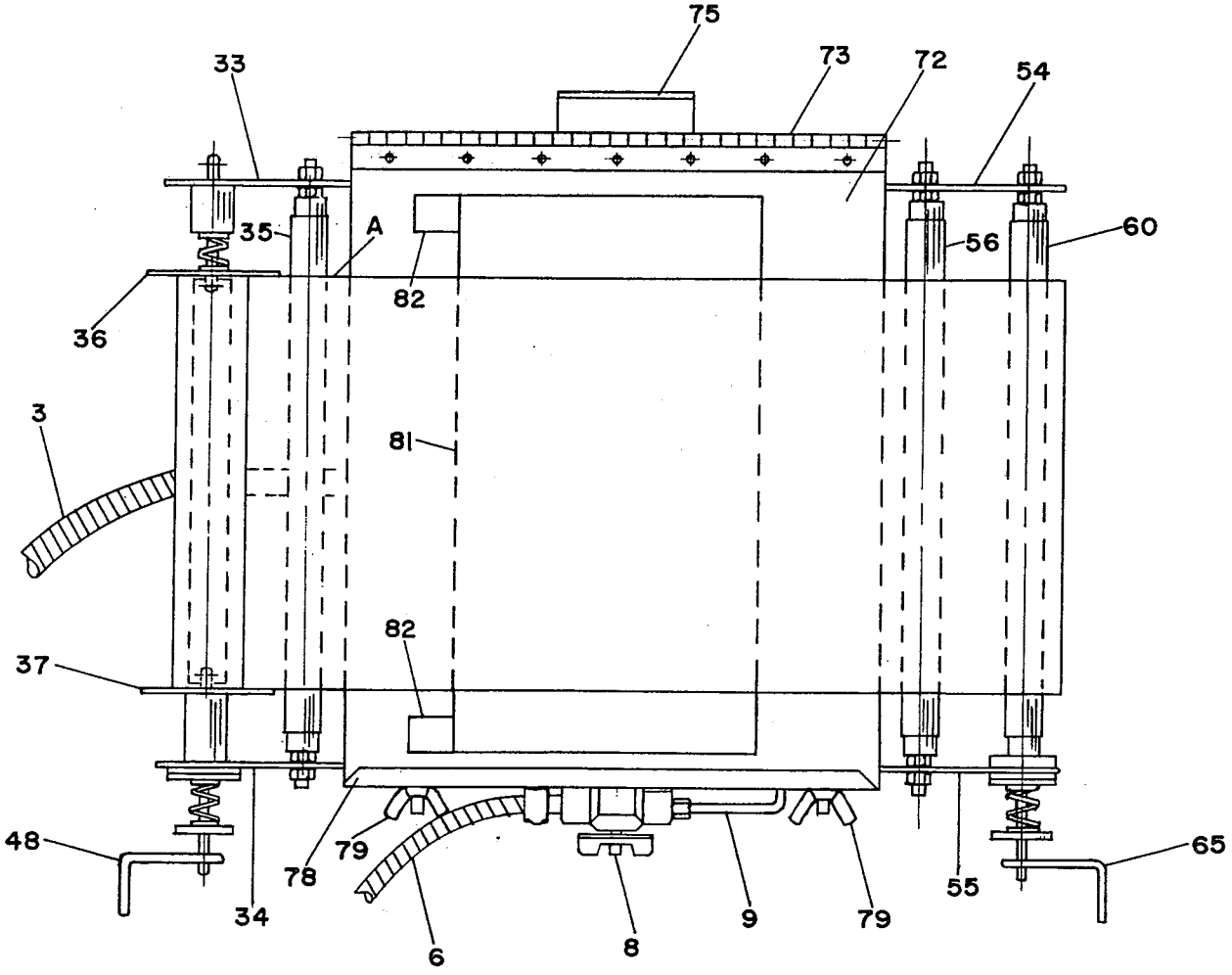
FIG. 11 is a top view of the embodiment, showing writing-film A being wound over the top of the lid back onto its original spool, the direction of film travel being from right to left; drawn one-quarter actual size.

Writing-film A is shown travelling over the lid 72,80,81, back onto its original spool, in FIG. 11.

I claim:

1. A machine for removing ink from an overhead projector roll of writing-film, comprising:

(a) means for holding the overhead projector roll of writing-film, the holding means permitting the roll of writing-film to rotate longitudinally and to be unrolled;

(b) a rotatable take-up spool for rerolling the writing-film, whereby the writing-film is transferred unrolled from the holding means to the take-up spool;
(c) means for turning the take-up spool;
(d) a basin located between the holding means and the take-up spool so as to permit the writing-film to travel unrolled across the basin as the writing-film is being transferred unrolled from the holding means to the take-up spool;
(e) a cover over the basin, a space between the cover and the basin permitting the writing-film to pass unrolled between the cover and the basin;
(f) means, located in the basin, for spraying solvent of the said ink onto the writing-film as the writing-film travels unrolled across the basin to the take-up spool; and
(g) means for removing said solvent from the writing-film as the writing-film travels unrolled to the take-up spool.

2. A machine as defined in claim 1, wherein said spraying means includes at least one nozzle.

3. A machine as defined in claim 1, wherein said means for removing solvent from the writing-film comprises at least one resilient wiper blade situated so as to press against the writing-film as the writing-film is being transferred unrolled from the holding means to the take-up spool.

4. A machine as defined in claim 1, further comprising means for turning an overhead projector spool held by the holding means, whereby the writing-film is wound back from the take-up spool and onto the overhead projector spool.

5. A machine for removing ink from an overhead projector roll of writing-film, comprising:
(a) means for holding the overhead projector roll of writing-film, the holding means permitting the roll of writing-film to rotate longitudinally and to be unrolled;
(b) a rotatable take-up spool for rerolling the writing-film, whereby the writing-film is transferred unrolled from the holding means to the take-up spool;
(c) means for turning the take-up spool;
(d) a basin located between the holding means and the take-up spool so as to permit the writing-film to travel unrolled across the basin as the writing-film is being transferred unrolled from the holding means to the take-up spool;
(e) a lid for covering the basin, a space between the lid and the basin permitting the writing-film to pass unrolled between the lid and the basin when the lid is closed, said lid having a rough textured bottom surface;
(f) means for fastening, releasably, the lid in a closed position;
(g) means, located in the basin, for spraying solvent of the said ink towards the lid onto the writing-film as the writing-film travels unrolled across the basin to the take-up spool;
(h) means, located in the basin, for wiping said solvent from the writing-film as the writing-film travels unrolled across the basin to the take-up spool; and
(i) means for withdrawing said solvent from the bottom of the basin.

6. A machine as defined in claims 1 or 5, wherein said means for holding the overhead projector roll of writing-film includes two rotatable discs facing each other at a distance of between twenty and thirty centimeters, one disc having a fixed position and one disc being retractable; a spring situated behind the retractable disc for resisting retraction of the retractable disc; and, situated at the center of the inside face of each disc, a protrusion which fits into either end of an overhead projector spool.

7. A machine as defined in claims 1 or 5, wherein said take-up spool is between twenty-five and forty-five centimeters in length, and said means for turning the take-up spool is a crank connected to one end of the take-up spool.

8. A machine as defined in claims 1 or 5, further comprising two rotatable idle rollers, one idle roller situated above the holding means and one idle roller situated above the take-up spool, both idle rollers being approximately level with the upper periphery of the basin so as to assist in guiding the writing-film across the basin as the writing-film is being transferred unrolled from the holding means to the take-up spool.

9. A machine as defined in claim 5, wherein said spraying means includes at least one nozzle.

10. A machine as defined in claim 9, wherein said nozzle comprises means for forming a cone-shaped spray of solvent.

11. A machine as defined in claim 9, further comprising a shield surrounding the nozzle, said shield partitioning the nozzle from the wiping means, resilient material being present on the upper periphery of the shield to make slidable sealing contact with the writing-film as the writing-film travels unrolled across the basin to the take-up spool.

12. A machine as defined in claim 9, further comprising a valve for controlling solvent flow to the nozzle.

13. A machine as defined in claim 5, wherein said wiping means comprises at least one resilient wiper blade mounted in the basin so as to be transverse to the direction of writing-film travel and at such an elevation that the wiper blade presses the writing-film against the inside surface of the lid, when the lid is closed, and wipes the writing-film as the writing-film travels unrolled across the basin to the take-up spool.

14. A machine as defined in claim 13, wherein said wiper blade is pivotally mounted, whereby the wiper blade applies pressure more evenly across the width of the writing film.

15. A machine as defined in claim 5, further comprising means for turning an overhead projector spool held by the holding means, whereby the writing-film is wound back from the take-up spool and onto the overhead projector spool.

16. A machine as defined in claims 4 or 15, further comprising means for wiping the writing-film with absorbent matter as the writing-film is being wound from the take-up spool to the overhead projector spool.

17. A machine for removing ink from an overhead projector roll of writing-film, comprising:
(a) means for holding the overhead projector roll of writing-film, the holding means permitting the roll of writing-film to rotate longitudinally and to be unrolled;
(b) a rotatable take-up spool for rerolling the writing-film, whereby the writing-film is transferred unrolled from the holding means to the take-up spool;
(c) means for turning the take-up spool;
(d) a basin located between the holding means and the take-up spool so as to permit the writing-film to travel unrolled across the basin as the writing-film is being transferred unrolled from the holding means to the take-up spool;

(e) a hinged lid for covering the basin, a space between the lid and the basin permitting the writing-film to pass unrolled between the lid and the basin when the lid is closed, said lid having a rough textured bottom surface;

(f) means for fastening, releasably, the lid in a closed position;

(g) at least one nozzle, located in the basin, for spraying water towards the lid onto the bottom surface of the writing-film as the writing-film travels unrolled across the basin to the take-up spool;

(h) tubing connected to the incurrent end of the nozzle;

(i) means for coupling the tubing to a water faucet;

(j) at least one resilient wiper blade mounted in the basin so as to be transverse to the direction of writing-film travel and at such an elevation that the wiper blade presses the writing-film against the inside surface of the lid, when the lid is closed, and wipes the writing-film as the writing-film travels unrolled across the basin to the take-up spool;

(k) a shield surrounding the nozzle, said shield partitioning the nozzle from the wiper blade, resilient material being present on the upper periphery of the shield to make slidable sealing contact with the writing-film as the writing-film travels unrolled across the basin to the take-up spool; and (l) a drainhose, connected to a hole in the bottom of the basin, for withdrawing said water from the basin.

18. A machine as defined in claims 5 or 17, further comprising adjustable means for impeding rotation of the roll of writing-film when the roll of writing-film is held by the holding means.

19. A machine as defined in claim 17, further comprising means for turning an overhead projector spool held by the holding means, whereby the writing-film is wound back from the take-up spool and onto the overhead projector spool via the top surface of the said lid.

20. A machine as defined in claims 15 or 19, further comprising adjustable means for impeding rotation of the take-up spool as the writing-film is being wound from the take-up spool onto the overhead projector spool.

21. A machine as defined in claims 15 or 19, further comprising a pair of cloth covered plates between which the writing-film slides as the writing-film is being wound from the take-up spool to the overhead projector spool, said cloth covered plates wiping residual amounts of moisture from the writing-film.

22. A machine for removing ink from an overhead projector roll of writing-film, comprising:

(a) means for holding the overhead projector roll of writing-film; said holding means comprising two rotatable discs facing each other at a distance of between twenty and thirty centimeters, one disc having a fixed position and one disc being retractable, a spring situated behind the retractable disc for resisting retraction of the retractable disc, and, situated at the center of the inside face of each disc, a protrusion which fits into either end of an overhead projector spool; said holding means permitting the roll of writing-film to rotate longitudinally and to be unrolled;

(b) a rotatable take-up spool for rerolling the writing-film, whereby the writing-film is transferred unrolled from the holding means to the take-up spool;

(c) means for turning the take-up spool;

(d) means for conveying a flow of water to the said machine from a pressurized water source external to the said machine;

(e) means for applying the said water to the writing-film as the writing-film is being transferred unrolled from the holding means to the take-up spool;

(f) means for immediately discarding from the said machine water that has been applied to the writing-film and ink that has dissolved in water applied to the writing-film; and (g) means for removing from the writing-film water that clings to the writing-film.

* * * * *